US006658328B1

(12) United States Patent
Alrabady et al.

(10) Patent No.: US 6,658,328 B1
(45) Date of Patent: Dec. 2, 2003

(54) PASSIVE FUNCTION CONTROL SYSTEM FOR A MOTOR VEHICLE

(75) Inventors: Ansaf Ibrahem Alrabady, Livonia, MI (US); David Leonard Juzswik, Commerce, MI (US)

(73) Assignee: TRW Inc., Lyndhurst, OH (US)

( * ) Notice: Subject to any disclaimer, the term of this patent is extended or adjusted under 35 U.S.C. 154(b) by 16 days.

(21) Appl. No.: 10/051,783

(22) Filed: Jan. 17, 2002

(51) Int. Cl.[7] ..... G08C 19/00

(52) U.S. Cl. ..... 701/1; 701/36; 307/10.2; 340/426.13; 340/5.2; 340/426.1

(58) Field of Search ..... 701/1, 36; 307/10.2; 340/426.1, 825.31, 5.1, 5.2, 5.21, 5.22, 5.23, 426.13, 426.17, 426.36

(56) References Cited

U.S. PATENT DOCUMENTS

| | | | | | |
|---|---|---|---|---|---|
| 4,794,268 | A | | 12/1988 | Nakano et al. | |
| 4,942,393 | A | | 7/1990 | Waraksa et al. | |
| 5,144,667 | A | * | 9/1992 | Pogue et al. | 380/45 |
| 5,319,364 | A | | 6/1994 | Waraksa et al. | |
| 5,412,379 | A | * | 5/1995 | Waraksa et al. | 340/5.26 |
| 5,442,341 | A | * | 8/1995 | Lambropoulos | 340/5.26 |
| 5,515,036 | A | * | 5/1996 | Waraksa et al. | 340/825.72 |
| 5,523,746 | A | * | 6/1996 | Gallagher | 340/5.61 |
| 5,604,488 | A | * | 2/1997 | Lambropoulos | 340/5.26 |
| 5,682,135 | A | | 10/1997 | Labonde | |
| 5,723,911 | A | * | 3/1998 | Glehr | 340/10.5 |
| 5,937,065 | A | * | 8/1999 | Simon et al. | 380/262 |
| 5,973,611 | A | * | 10/1999 | Kulha et al. | 340/5.62 |
| 6,097,307 | A | * | 8/2000 | Utz | 340/5.8 |
| 6,218,932 | B1 | | 4/2001 | Stippler | |
| 6,323,566 | B1 | * | 11/2001 | Meier | 307/10.2 |

OTHER PUBLICATIONS

An article entitled "New Door Closure Concepts", Automotive Engineering International/Sep. 2000, pp. 118–120.

* cited by examiner

*Primary Examiner*—William A Cuchlinski, Jr.
*Assistant Examiner*—Eric M Gibson
(74) *Attorney, Agent, or Firm*—Tarolli, Sundheim, Covell & Tummino L.L.P.

(57) ABSTRACT

A passive function control system (10) for a motor vehicle and a method of operating the system (10) are provided. The system (10) includes a vehicle based transceiver (14) for transmitting a challenge signal having a random number and an identification code. At least a portion of the random number and at least a portion of the identification code of the challenge signal are encrypted. A portable transceiver (16) receives the challenge signal and decrypts the encrypted portions of the challenge signal. The portable transceiver (16) transmits a challenge response signal having the random number only in response to a comparison of the identification code to a reference identification code indicating a match. A first controller (18) of the vehicle based transceiver (14) responds to the challenge response signal when the challenge response signal is related to the random number.

16 Claims, 3 Drawing Sheets

PASSIVE FUNCTION CONTROL SYSTEM FOR A MOTOR VEHICLE

TECHNICAL FIELD

The present invention relates to a passive function control system for a motor vehicle. More particularly, the present invention relates to a passive entry system for a keyless vehicle.

BACKGROUND OF THE INVENTION

Passive entry systems for gaining access to the interior of a vehicle are known. Known passive entry systems include a vehicle based transceiver and a portable transceiver that is carried by an authorized user. When the authorized user approaches the vehicle, the vehicle based transceiver transmits a low frequency challenge signal. In one known system, the challenge signal is transmitted in response to the authorized user triggering a sensor in a door handle of the vehicle. The challenge signal is a random number.

In response to receiving the challenge signal, the portable transceiver generates a challenge response signal. In generating the challenge response signal, the portable transceiver encrypts the random number using an encryption key. The encrypted random number is transmitted as the challenge response signal.

While the vehicle based transceiver is waiting for the challenge response signal, the vehicle based transceiver encrypts the random number using an encryption key that is identical to the encryption key of the portable transceiver. The result of the encrypted random number is an expected response. Upon receiving the challenge response signal from the portable transceiver, the vehicle based transceiver compares the challenge response signal received to the expected response. The vehicle based transceiver controls a locking mechanism of the vehicle to allow access into the interior of the vehicle when the challenge response signal matches the expected response.

Known passive entry systems are susceptible to "dictionary" attacks. In a dictionary attack, an unauthorized user uses a device to transmit a plurality of random challenge messages in the vicinity of the portable transceiver. The portable transceiver responds to each random challenge message with a challenge response signal. The unauthorized user uses another device to record the challenge response signals transmitted from the portable transceiver. After building a database or dictionary of challenge response signals, the unauthorized user goes to the vehicle and begins triggering the vehicle based transceiver to transmit challenge signals. The unauthorized user transmits responses from the dictionary. If the unauthorized user's dictionary has the valid challenge response signal to the challenge signal transmitted from the vehicle based transceiver, the unauthorized user is allowed to access the interior of the vehicle.

The dictionary attack is a statistical approach to gaining access to the vehicle. The probability of gaining access through the use of the dictionary attack is dependent upon the number of challenge response signals stored in the dictionary and the word size or number of bits dedicated to the random number of the challenge signal. A need exists for a passive entry system that is not susceptible to a dictionary attack.

SUMMARY OF THE INVENTION

In accordance with an exemplary embodiment of the present invention, a passive function control system for a vehicle is provided. The system comprises a vehicle based transceiver for transmitting a challenge signal. The vehicle based transceiver includes a first controller, a random number generator, a first encryption key, and a memory for storing an identification code. The first controller provides the challenge signal having a random number from the random number generator and the identification code from the memory. The first controller encrypts at least a portion of the random number and at least a portion of the identification code of the challenge signal using the first encryption key. The system also comprises a portable transceiver for receiving the challenge signal and for transmitting a challenge response signal. The portable transceiver comprises a second controller, a second memory for storing a reference identification code, and a decryption key corresponding to the first encryption key of the vehicle based transceiver. The second controller decrypts the encrypted portions of the challenge signal using the decryption key, compares the identification code to the reference identification code, and outputs the challenge response signal having the random number only in response to identification code comparison indicating a match. The first controller responds to the challenge response signal when the random number of the challenge response signal is related to the random number from the random number generator.

In accordance with the present invention, an exemplary method of operation of a passive function control system of a vehicle is provided. During the method, a challenge signal is provided which includes a random number and an identification code. At least a portion of the random number and at least a portion of the identification code of the challenge signal are encrypted. The challenge signal is transmitted from a vehicle based transceiver. The challenge signal is received at a portable transceiver. The encrypted portions of the challenge signal are decrypted. The identification code is compared to a reference identification code. A challenge response signal having the random number is transmitted only in response to identification code comparison indicating a match. The challenge response signal is received at the vehicle based transceiver. The vehicle based transceiver responds to the challenge response signal when the random number of the challenge response signal is related to the random number.

BRIEF DESCRIPTION OF THE DRAWINGS

The foregoing and other features of the present invention will become apparent to those skilled in the art to which the present invention relates upon reading the following description with reference to the accompanying drawings, in which.

DETAILED DESCRIPTION OF THE INVENTION

Figure 1:
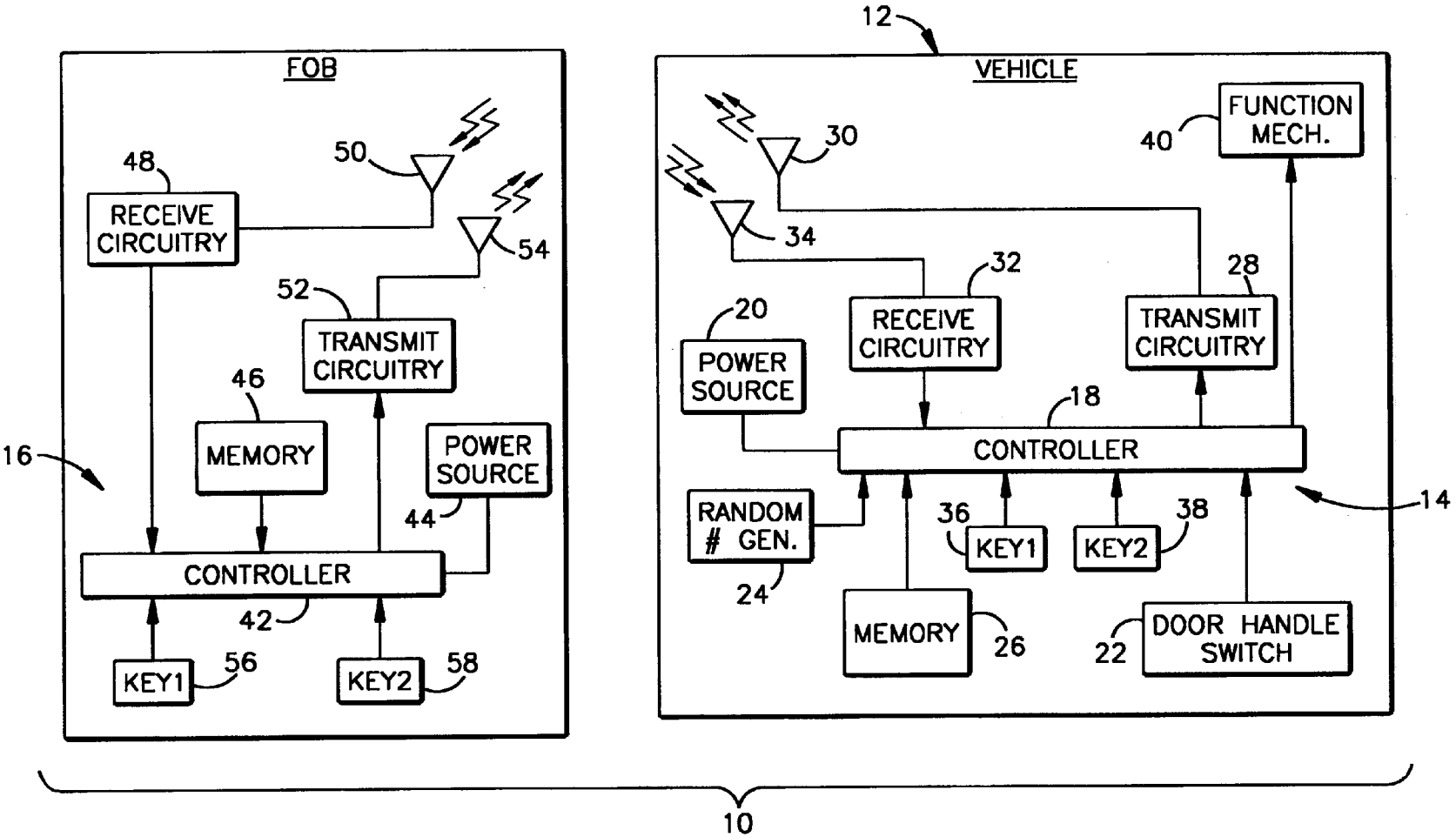
FIG. 1 is a schematic functional block diagram of a passive function control system constructed in accordance with the present invention.

FIG. 1 is a schematic functional block diagram of a passive function control system 10 constructed in accordance with an exemplary embodiment of the present invention. The passive function control system 10 will be discussed below in the context of permitting an authorized user access into the interior of a vehicle 12 through an entryway (i.e., a door of the vehicle). The passive function control system 10 may also be used for other functions, such as starting the vehicle's ignition once access into the vehicle's interior is gained.

The passive function control system 10 of FIG. 1 includes a vehicle based transceiver 14 and a portable transceiver 16. The vehicle based transceiver 14 is attached to the vehicle 12, such as in the vehicle's instrument panel (not shown). The portable transceiver 16 may take to the form of a key fob or a credit card and is easily carried by an authorized person or user.

The vehicle based transceiver 14 includes a controller 18. Preferably, the controller 18 is a microcomputer. Alternatively, the controller 18 may be formed from analog or discrete circuit components or an application specific integrated circuit.

The controller 18 is operatively connected to a power source 20. Preferably, the power source 20 is the vehicle battery through appropriate regulating circuitry (not shown). The controller 18 illustrated in FIG. 1 receives electrical power from the power source 20 and controls application of electrical power to the other components of the vehicle based transceiver 14 that require electrical energy.

A user proximity sensor 22 is operatively connected to the controller 18. The user proximity sensor 22 illustrated in FIG. 1 is a door handle switch. The door handle switch 22 is operative to send a proximity signal to the controller 18 when a user touches a door handle of the vehicle 12. The door handle switch 22 is generally known in the art. As an alternative to a door handle switch 22, any known device that senses a user's proximity to the vehicle and provides a proximity signal to the controller 18 in response to a user's proximity to the vehicle may be used as the user proximity sensor.

The controller 18 has two modes of operation; a sleep mode and a function mode. The sleep mode reduces the power consumption of the vehicle based transceiver 14. The controller 18 enters the sleep mode after a predetermined period of inactivity. When the controller 18 receives the proximity signal from the door handle switch 22, the controller enters the function mode.

A random number generator 24 is also operatively connected to the controller 18. Alternatively, the random number generator 24 may form a portion of controller 18 or may include software operating in the controller. The random number generator 24 is a known device that executes a program or algorithm to generate a random number. The random number is placed in the form of a digital word having a given number of bits. Thus, the random number is only random in the fact that the random number generated is generally unpredictable and no number is any more likely to occur at a given time or place in the sequence of the random number than any other number. The random number generator provides the random number to the controller 18.

A memory 26 is also operatively connected to the controller 18. Alternatively, the memory 26 may form a portion of controller 18. The memory 26 is a nonvolatile memory in which is stored an identification code. When prompted by the controller 18, the memory 26 provides the identification code to the controller.

The identification code is a digital word having a given number of bits. The identification code includes a most significant bit portion and a least significant bit portion. The most significant bits are the highest order or leftmost bits in the digital word. The least significant bits are the lowest order or rightmost bits of the digital word.

Transmit circuitry 28 and a transmitting antenna 30 are also operatively connected to the controller 18. As will be described in detail below, the controller 18 outputs a challenge signal to the transmit circuitry 28. The transmit circuitry 28 transmits the challenge signal via the transmitting antenna 30. Preferably, the transmitted challenge signal is a low frequency signal. In one embodiment, the challenge signal has a frequency of about 125 kHz. Preferably, the low frequency challenge signal has a range of approximately one meter from the transmitting antenna 30.

In the embodiment illustrated in FIG. 1, the transmitting antenna 30 is a loop antenna that extends from the controller 18 to a position near the door handle of the vehicle 12. Preferably, a transmitting antenna 30 is associated with each door handle of the vehicle 12.

Receive circuitry 32 and a receiving antenna 34 are also operatively connected to the controller 18. The receiving antenna 34 receives a challenge response signal. The receive circuitry 32 demodulates and filters the challenge response signal and provides the challenge response signal to the controller 18. The filtering of the challenge response message removes noise that is located outside of a frequency range in which the challenge response message is transmitted. In one embodiment, the challenge response signal received is a radio frequency signal.

First and second encryption keys 36 and 38, respectively, are also operatively connected to the controller 18. Alternatively, the first and second encryption keys 36 and 38 may form a portion of controller 18 or may be included as part of the software operating in the controller. The first and second encryption keys 36 and 38 each include an encryption code, i.e., a sequence of data, that is used to encrypt other data. The controller 18 uses the encryption codes of the first and second encryption keys 36 and 38 to encrypt portions of the challenge signal. Preferably, the first and second encryption keys 36 and 38 have different encryption codes.

A function mechanism 40 is also operatively connected to the controller 18. The controller 18 controls operation of the function mechanism 40. For example, in the embodiment of FIG. 1, the function mechanism 40 is a door locking mechanism. The function mechanism 40, i.e., door locking mechanism, receives function signals from the controller 18 and, in response to the function signals, controls the locking and the unlocking of the vehicle doors.

The portable transceiver 16 includes a controller 42. Preferably, the controller 42 is a microcomputer. Alternatively, the controller 42 may be formed from analog or discrete circuit components or an application specific integrated circuit.

The controller 42 is operatively connected to a power source 44. Preferably, the power source 44 is a long life battery. The controller 42 illustrated in FIG. 1 receives electrical power from the power source 44 and controls distribution of electrical power to the other components of the portable transceiver 16 that require electrical energy.

As an alternative to having the power source 44, the portable transceiver 16 may be powered by induction. When powered by induction, the low frequency challenge signal transmitted by the vehicle based transceiver 14 induces a current in the portable transceiver 16. The induced power is sufficient for operating the portable transceiver.

The controller 42 of the portable transceiver 16 has two operating modes; a sleep mode and a function mode. In the sleep mode, the controller 42 uses very little or no electrical energy. The controller 42 defaults to the sleep mode. Upon receiving a challenge signal, the controller 42 "wakes up" and enters the function mode. Operation of the controller 42 in the function mode is described below.

A memory 46 is also operatively connected to the controller 42 of the portable transceiver 16. Alternatively, the memory 46 may form a portion of controller 42. The memory 46 is a nonvolatile memory in which is stored a reference identification code. When prompted by the controller 42, the memory 46 provides the reference identification code to the controller.

The reference identification code is a digital word and is identical to the identification code of the associated vehicle based transceiver 14. Thus, the most significant bits and the least significant bits of the reference identification code are identical to the most significant bits and the least significant bits of the identification code.

Receive circuitry 48 and a receiving antenna 50 are operatively connected to the controller 42. The receiving antenna 50 receives the challenge signal that the vehicle based transceiver 14 transmits. The receive circuitry 48 demodulates and filters the challenge signal and provides the challenge signal to the controller 42. The filtering of the challenge signal removes noise that is located outside of a frequency range in which the challenge signal is transmitted.

Transmit circuitry 52 and a transmitting antenna 54 are also operatively connected to the controller 42. The controller 42 outputs a challenge response signal to the transmit circuitry 52. The transmit circuitry 52 transmits the challenge response signal via the transmitting antenna 54. Preferably, the transmitted challenge response signal is a radio frequency signal.

A decryption key 56 and an encryption key 58 are also operatively connected to the controller 42. Alternatively, the decryption key 56 and the encryption key 58 may form a portion of controller 42 or may be included as part of the software operating in the controller. The decryption key 56 includes a decryption code or a sequence of data that is used to decrypt received messages. The controller 42 uses the decryption code of the decryption key 56 to decrypted data received in the challenge signal. The encryption key 58 includes an encryption code or a sequence of data that is used to encrypt messages. The controller 42 uses of the encryption code of encryption key 58 to encrypted data to be output in the challenge response signal. Preferably, the decryption key 56 and the encryption key 58 have different codes.

Operation of the passive function control system 10 is discussed below. During the discussion, the term "user" is used to mean any person or thing that initiates a challenge signal from the vehicle based transceiver 14. The term "authorized user" is used to mean any user having possession of the associated portable transceiver 16. The term "unauthorized user" is used to mean any user not having. possession of associated the portable transceiver 16. A user having a similar portable transceiver with a different reference identification code stored in its memory is an unauthorized user.

The controller 18 of the vehicle based transceiver 14 is generally in the sleep mode. In the sleep mode, the controller 18 monitors for a proximity signal from the door handle switch 22. When a user initiates the door handle switch 22 to provide a proximity signal to the controller 18, the controller "wakes up" and enters a function mode.

In the function mode, the controller 18 of the vehicle based transceiver 14, prompts the memory 26 to provide the identification code, prompts the random number generator 24 to provide a random number, and prompts the first encryption key 36 to provide its encryption code. The controller 18 uses the encryption code from the first encryption key 36 to encrypt at least a portion of the random number and at least a portion of the identification code. As shown schematically in FIG. 4, in one embodiment, the controller 18 uses the encryption code, indicated at 402 in FIG. 4, from the first encryption key 36 to encrypt the entire random number 404 and the most significant bits of the identification code 406 to get the encrypted portion 412.

Figure 4:
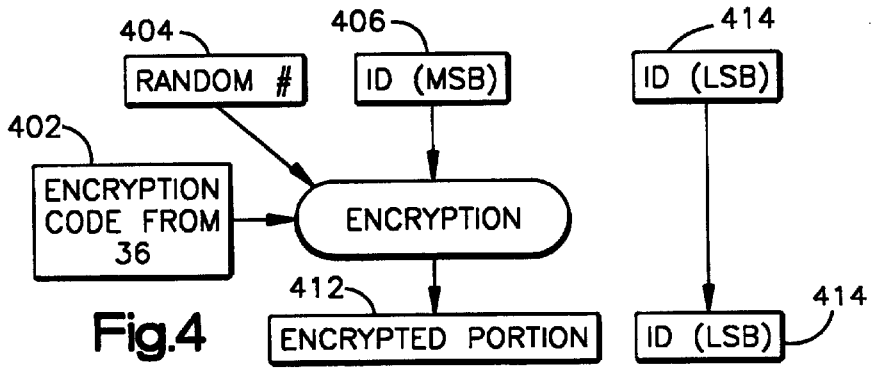
FIG. 4 schematically illustrates the encryption of a random number and a portion of an identification code in the vehicle based transceiver of FIG. 1.

The controller 18 then assembles a challenge signal to be transmitted. The challenge response signal includes a message packet. In one exemplary embodiment, the message packet includes a 64-bits. The message packet includes the encrypted portion of the identification code, the encrypted portion of the random number, any non-encrypted portions of the identification code and the random number, and a wake-up code or preamble. The wake-up code is a digital word that is to indicate to the controller 42 of the portable transceiver 16 to enter the function mode. The message packet may also include other bits, such as checksum bits. With reference to FIG. 4, the message packet would include the encrypted portion 412, including the encrypted random number and the encrypted most significant bits of the identification code, and the non-encrypted least significant bits of the identification code 414, a wake-up code (not shown), and any other bits, such as checksum bits (not shown).

After assembling the challenge signal, the controller 18 of the vehicle based transceiver 14 outputs the challenge signal to the transmit circuitry 28. The transmit circuitry 28 transmits the challenge signal, which includes the message packet, via the transmitting antenna 30.

After the challenge signal is transmitted, the controller 18 of the vehicle based transceiver 14 performs two functions. First, the controller 18 monitors receive circuitry 32 for a challenge response signal. Second, the controller 18 calculates an expected response from the portable transceiver 16.

To calculate the expected response from the portable transceiver 16, the controller 18 prompts the second encryption key 38 for its encryption code. After receiving the encryption code from the second encryption key 38, the controller 18 encrypts the random number that was received from the random number generator 24 using the encryption code from the second encryption key 38. The controller 18 saves the expected response for comparison to any received challenge response signals. Alternatively, the expected response may be the random number, non-encrypted.

The antenna 50 of the portable transceiver 16 receives the transmitted challenge signal. The antenna 50 transfers the received challenge signal to receive circuitry 48. Receive circuitry 48 demodulates and filters the received challenge signal and transfers the received challenge signal to controller 42.

When the controller 42 of the portable transceiver 16 receives the challenge signal, the wake-up code of the message packet causes the controller 42 of the portable transceiver to enter its function mode. The controller 42 then prompts its memory 46 to provide the reference identification code. Upon receiving the reference identification code, the controller 42 compares the non-encrypted portion of the identification code of the received message packet of the challenge signal, if a portion of the identification code is non-encrypted, with a corresponding portion of the reference identification code. For example, if receiving a message packet having the encrypted portion 412 shown in FIG. 4, the controller 42 compares the least significant bits of the identification code 414 with the least significant bits of the reference identification code.

If the non-encrypted portion of the identification code fails to match the corresponding portion of the reference identification code, the controller 42 of the portable transceiver 16 ignores the challenge signal and returns to the sleep mode. If the non-encrypted portion of the identification code matches the corresponding portion of the reference identification code, the controller 42 prompts the decryption key 56 to provide its decryption code. The controller 42 then decrypts the encrypted portions of the message packet of the challenge signal. For example, with reference to FIG. 4, the controller 42 will decrypt the encrypted portion 412 to get the random number 404 and the most significant bits of the identification code 406.

Since the decryption code of the decryption key 56 corresponds to the encryption code of the first encryption key 36, decryption of the encrypted portions of the message packet results in the random number and a remainder of the identification code. The controller 42 then compares the remainder of the identification code, the most significant bits 406 in FIG. 4, to a corresponding portion of the reference identification code. If the remainder of the identification code fails to match the corresponding portion of the reference identification code, the controller 42 ignores the challenge signal and returns to the sleep mode. If the remainder of the identification code matches the corresponding portion of the reference identification code, the controller 42 assembles a challenge response signal to be transmitted.

In assembling the challenge response signal, the controller 42 prompts the encryption key 58 for its encryption code. The controller 42 uses the encryption code from the encryption key 58 to encrypt at least a portion of the random number. The encryption code of the encryption key 58 corresponds to the encryption code of the second encryption key 38 of the vehicle based transceiver 14. The challenge response signal may also include other portions such as a preamble. As an alternative to including the encrypted random number, the challenge response signal may include the random number, non-encrypted.

The controller 42 then outputs the challenge response signal to transmit circuitry 52 of the portable transceiver 16. The transmit circuitry 52 transmits the challenge response signal via its antenna 54.

The receiving antenna 34 of the vehicle based transceiver 14 receives the challenge response signal. The challenge response signal is transferred to the receive circuitry 32 of the vehicle based transceiver 14. In the receive circuitry 32, the challenge response signal is demodulated and filtered.

The challenge response signal is sent to the controller 18.

In response to receiving the challenge response signal, the controller 18 compares the encrypted random number of the challenge response signal, or the non-encrypted random number if the random number is not encrypted in the portable transceiver 16, to the expected response that the controller calculated. If the encrypted random number (or non-encrypted) and the expected response fail to match, the message packet is ignored and access into the vehicle 12 is denied. If the encrypted (or non-encrypted) random number and the expected response match, the controller 18 outputs a function signal to the function mechanism 40 to control the function mechanism to permit access into the interior of the vehicle 12.

Figure 2:
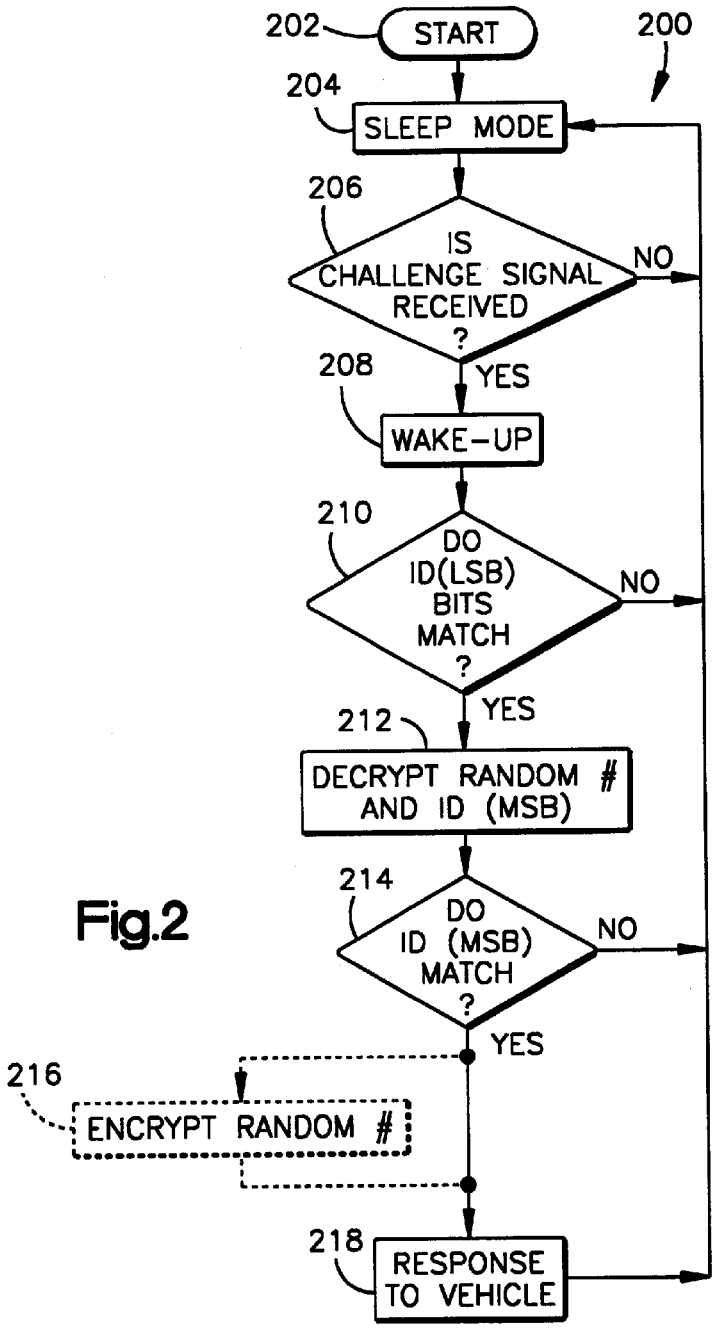
FIG. 2 is a flow diagram illustrating a process of operation of a portable transceiver of FIG. 1.

FIG. 2 is a flow diagram illustrating a process 200 of operation of a portable transceiver 16 of FIG. 1. The process 200 starts at step 202 in which the controller 42 is initialized, memories are cleared and set to initial values, and flags are set to initial conditions, etc. The process 200 then proceeds to step 204. At step 204, the portable transceiver 16 is in a sleep mode or a low power consumption mode. The process 200 proceeds to step 206. At step 206, a determination is made as to whether a challenge signal is received. If the determination at step 206 is negative, the process 200 returns to step 204. If the determination at step 206 is affirmative, the process 200 proceeds to step 208.

At step 208, the controller 42 of the portable transceiver 16 wakes up and enters the function mode. As part of step 208, the controller 42 prompts memory 46 to provide the reference identification code. The process 200 then proceeds to step 210.

At step 210, a determination is made as to whether the non-encrypted portion of the identification code sent in the challenge signal matches a corresponding portion of the reference identification code. In one embodiment, at step 210, a determination is made as to whether the least significant bits of the identification code 414 match the least significant bits of the reference identification code. If the determination at step 210 is negative, the process 200 returns to step 204. If the determination at step 210 is affirmative, the process 200 proceeds to step 212.

At step 212, the process 200 decrypts the encrypted portions of the received challenge signal. During step 212, the controller 42 of the portable transceiver 16 prompts the decryption key 56 to provide its decryption code. The controller 42 uses the decryption code to decrypt the encrypted portions. After the encrypted portions are decrypted, the process 200 proceeds to step 214. In one embodiment, the decryption at step 212 results in the random number 404 and the most significant bits of the identification code 406.

At step 214, the process 200 determines whether the encrypted portion of the identification code, that was decrypted at step 212, matches the corresponding portion of the reference identification code. For example, step 214 determines if the most significant bits of the identification code 406 match the most significant bits of the reference identification code. If the determination at step 214 is negative, the process 200 returns to step 204. If the determination at step 214 is affirmative, the process 200 proceeds to step 218. At step 218, the portable transceiver transmits the challenge response signal having the random number.

Alternatively, in response to an affirmative determination at step 214, the process 200 may proceed to step 216. At step 216, the controller 42 of the portable transceiver 16 prompts the encryption key 58 for its encryption code. The controller 42 encrypts the random number using the encryption code. The controller 42 outputs a challenge response signal that includes the encrypted random number. The process 200 then proceeds to step 218 in which the portable transceiver 16 transmits the challenge response signal.

By first comparing a clear or non-encrypted portion of the identification code and then, if a match is found, comparing the encrypted portion of the identification code, the verification speed of the portable transceiver 16 is increased and power consumption within the portable transceiver is decreased if a match is not determined. For example, if the least significant bits of the identification code 414 and the reference identification code do not match, the controller 42 immediately resumes the sleep mode without further comparison of the identification code. Since fewer than all of the bits of the identification code are compared when the non-encrypted portion of the identification code does not match the corresponding portion of the reference identification code, the controller 42 returns to the sleep mode sooner than if all of the identification code bits were compared and thus, power consumption within the portable transceiver 16 is decreased.

Figure 3:
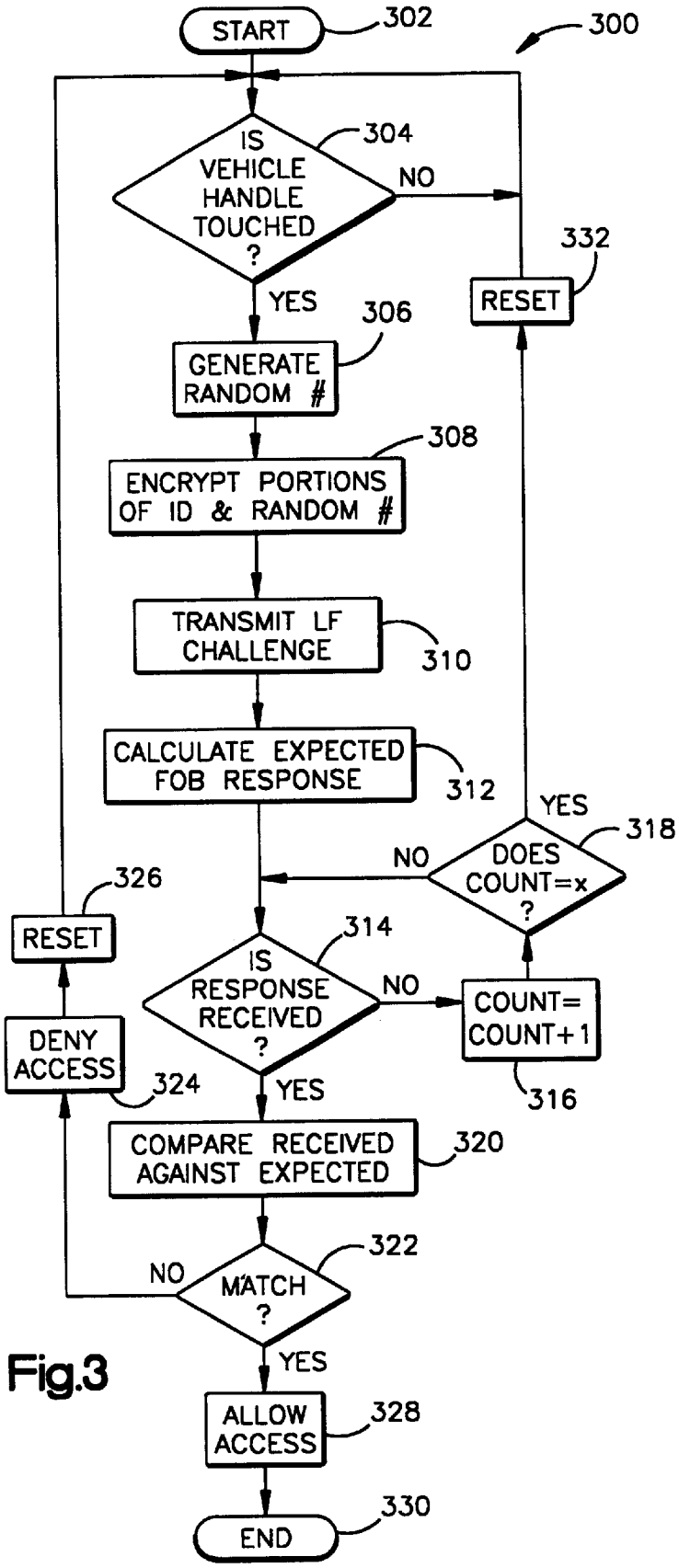
FIG. 3 is a flow diagram illustrating a process of operation of a vehicle based transceiver of FIG. 1.

FIG. 3 is a flow diagram illustrating a process 300 of operation of a vehicle based transceiver 14 of FIG. 1. The process 300 begins at step 302 in which the controller 18 is initialized, memories are cleared and set to initial values, and flags are set to initial conditions. The process 300 then proceeds to step 304. At step 304, a determination is made as to whether a user has touched the door handle of the vehicle 12, i.e., initiated a proximity signal to the controller 18. If the determination in step 304 is negative, the process 300 cycles back to step 304 until an affirmative response is determined. If the determination at step 304 is affirmative, the process 300 proceeds to step 306.

At step 306, the controller 18 prompts the random number generator for a random number. The process 300 proceeds to step 308. At step 308, the controller 18 prompts the first encryption key 36 for its encryption code. The controller 18 uses the encryption code from the first encryption key 36 to encrypt at least portions of the random number and at least a portion of the identification code. For example, in FIG. 4, the controller 18 encrypts the entire random number 404 and the most significant bits of the identification code 406. The controller 18 then assembles a challenge signal having the encrypted portions of the random number and the identification code and any non-encrypted portions of the random number and the identification code. The process 300 then proceeds to step 310.

At step 310, the vehicle based transceiver 14 transmits the challenge signal. The challenge signal includes an encrypted portion and a non-encrypted portion. The process 300 then proceeds to step 312.

At step 312, the controller 18 of the vehicle based transceiver 14 calculates an expected response from the portable transceiver 16. If the process 200 described above for the portable transponder 16 proceeds from directly to step 218 in response to an affirmative determination at step 214, then the expected response is the random number that was generated by the random number generator 24. However, if the process 200 proceeds to step 216 in response to an affirmative determination at step 214, then to calculate the expected response, the controller 18 encrypts the random number using the encryption code of the second encryption key 38. The process 300 then proceeds to step 314.

At step 314, a determination is made as to whether a challenge response signal has been received. If the determination in step 314 is negative, the process 300 proceeds to step 316. At step 316, a count is set equal to the previous count plus one. The count is initially set equal to zero at step 302. The process 300 proceeds from step 316 to step 318. At step 318, a determination is made as to whether the count equals a predetermined value, shown as X. If the determination at step 318 is negative, the process 300 returns to step 314. If the determination at step 318 is affirmative, the process 300 proceeds to step 332. At step 332, the count is reset equal to zero. The process 300 then returns to step 304.

If the determination at step 314 is affirmative, the process 300 proceeds to step 320. At step 320, the controller 18 compares the random number received in the challenge response signal to the expected response that the controller calculated. If the process 200 of the portable transceiver 16 included step 216, then the encrypted random number is compared to the expected response. The process 300 then proceeds to step 322. At step 322, a determination is made as to whether the received random number matches the expected response. If the determination is negative, the process 300 proceeds to step 324 in which access to the interior of the vehicle 12 is denied. From step 324, the process 300 proceeds to step 326. In step 326, the expected response is cleared or reset. The process 300 then returns to step 304. Alternatively, the process 300 may proceed from step 324 back to step 314 and wait for another response.

If the determination in step 322 is affirmative, the process 300 proceeds to step 328. At step 328, the controller 18 outputs a function signal to the function mechanism 40 and access into the interior of the vehicle 12 is permitted. The process 300 then proceeds to step 330 and the process ends.

The processes illustrated in the flow diagrams of FIGS. 2 and 3 prevent dictionary attacks. The portable transceiver 16 will not generate a challenge response signal unless the identification code is received. A portion of the identification code is encrypted along with a random number. Thus, an attacker is hindered from obtaining the identification code. As a result, the attacker is unable to build a dictionary for use in attacking the system.

From the above description of the invention, those skilled in the art will perceive improvements, changes and modifications. Such improvements, changes and modifications within the skill of the art are intended to be covered by the appended claims.

Having described the invention, we claim the following:

1. A passive function control system for a vehicle comprising:

a vehicle based transceiver for transmitting a challenge signal, the vehicle based transceiver including a first controller, a random number generator, a first encryption key, and a first memory for storing an identification code, the first controller providing the challenge signal having a random number from the random number generator and the identification code from the memory, the first controller encrypting at least a portion of the random number and at least a portion of the identification code of the challenge signal using the first encryption key; and a portable transceiver for receiving the challenge signal and for transmitting a challenge response signal, the portable transceiver comprising a second controller, a second memory for storing a reference identification code, and a decryption key corresponding to the first encryption key of the vehicle based transceiver, the second controller decrypting the encrypted portions of the challenge signal using the decryption key, comparing the identification code to the reference identification code, and outputting the challenge response signal, having the random number, only in response to identification code comparison indicating a match, the first controller responding to the challenge response signal when the random number of the challenge response signal is related to the random number from the random number generator.

2. The system as defined in claim 1 wherein the identification code stored in the first memory includes most significant bits and least significant bits, the at least a portion of the identification code that is encrypted by the first controller being the most significant bits of the identification code.

3. The system as defined in claim 2 wherein the reference identification code stored in the second memory also includes most significant bits and least significant bits, the second controller comparing the least significant bits of the identification code to the least significant bits of the reference identification code and comparing the most significant bits of the identification code to the most significant bits of the reference identification code only in response to least significant bit comparison indicating a match.

4. The system as defined in claim 1 further including a function mechanism, the first controller responding to the challenge response signal by outputting a function signal to control the function mechanism.

5. The system as defined in claim 1 further including a proximity sensor for sensing a user's proximity to the vehicle, the proximity sensor providing a proximity signal to the first controller in response to sensing a user's proximity, the first controller providing the challenge signal in response to the proximity signal.

6. The system as defined in claim 1 wherein the challenge signal is a low frequency signal.

7. The system as defined in claim 1 wherein the challenge response signal is a radio frequency signal.

8. The system as defined in claim 1 wherein the vehicle based transceiver includes a second encryption key and the portable transceiver includes a third encryption key that corresponds to the second encryption key, the second controller encrypting at least a portion of the random number of the challenge response signal using the third encryption key, the first controller calculating an expected response by encrypting the random number from the random number generator using the second encryption key, the first controller responding to the challenge response signal when the encrypted random number of the challenge response signal matches the expected response.

9. A method of operation of a passive function control system of a vehicle, the method comprising the steps of:

providing a challenge signal which includes a random number and an identification code;

encrypting at least a portion of the random number and at least a portion of the identification code of the challenge signal;

transmitting the challenge signal from a vehicle based transceiver;

receiving the challenge signal at a portable transceiver;

decrypting the encrypted portions of the challenge signal;

comparing the identification code to a reference identification code;

transmitting a challenge response signal, having the random number, only in response to identification code comparison indicating a match;

receiving the challenge response signal at the vehicle based transceiver; and responding to the challenge response signal when the random number of the challenge response signal is related to the random number.

10. The method as defined in claim 9 wherein the step of encrypting at least a portion of the identification code includes the steps of:

providing the identification code having most significant bits and least significant bits; and encrypting the most significant bits of the identification code.

11. The method as defined in claim 10 further including the steps of:

providing the reference identification code with most significant bits and least significant bits;

comparing the least significant bits of the identification code to the least significant bits of the reference identification code; and comparing the most significant bits of the identification code to the most significant bits of the reference identification code only in response to least significant bit comparison indicating a match.

12. The method as defined in claim 9 wherein the step of responding to the challenge response signal includes the step of:

outputting a function signal.

13. The method as defined in claim 9 further including the steps of:

sensing for a user's proximity to the vehicle;

providing a proximity signal in response to sensing a user's proximity; and providing the challenge signal in response to the proximity signal.

14. The method as defined in claim 9 wherein the step of transmitting the challenge signal from a vehicle based transceiver includes the step of:

transmitting a low frequency signal.

15. The method as defined in claim 9 wherein the step of transmitting a challenge response signal includes the step of:

transmitting a radio frequency signal.

16. The method as defined in claim 9 further including the steps of:

encrypting at least a portion of the random number of the challenge response signal in the portable transceiver;

calculating an expected response in the vehicle based transceiver by encrypting the random number; and responding to the challenge response signal when the encrypted random number of the challenge response signal matches the expected response.

* * * * *